US010710772B2

(12) United States Patent
Xing et al.

(10) Patent No.: US 10,710,772 B2
(45) Date of Patent: Jul. 14, 2020

(54) SOFT CORE BOTTLE

(71) Applicant: Beijing Xiaomi Mobile Software Co., Ltd., Beijing (CN)

(72) Inventors: Zheng Xing, Beijing (CN); Ningning Li, Beijing (CN); Lei Zhang, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 212 days.

(21) Appl. No.: 15/435,698

(22) Filed: Feb. 17, 2017

(65) Prior Publication Data

US 2017/0267404 A1 Sep. 21, 2017

(30) Foreign Application Priority Data

Mar. 16, 2016 (CN) ..... 2016 1 0150867

(51) Int. Cl.

| | |
|---|---|
| ***B65D 23/08*** | (2006.01) |
| ***A45F 3/16*** | (2006.01) |
| ***A61J 9/00*** | (2006.01) |
| ***B65D 1/02*** | (2006.01) |
| *A45F 3/18* | (2006.01) |
| *A45F 3/20* | (2006.01) |

(52) U.S. Cl.

CPC ..... *B65D 23/0885* (2013.01); *A45F 3/16* (2013.01); *A61J 9/00* (2013.01); *B65D 1/0207* (2013.01); *A45F 3/18* (2013.01); *A45F 3/20* (2013.01)

(58) Field of Classification Search

CPC ..... A61J 9/001; B65D 37/00; B65D 23/0885; A45F 3/16

See application file for complete search history.

(56) References Cited

U.S. PATENT DOCUMENTS

| | | | | |
|---|---|---|---|---|
| 2,876,113 A * | 3/1959 | Barton | A61J 9/001 215/11.3 |
| 3,784,039 A * | 1/1974 | Marco | A61J 9/001 215/11.3 |
| 4,796,767 A * | 1/1989 | McKeown | A61J 9/001 215/11.1 |
| 4,821,896 A * | 4/1989 | Cheng | A61J 9/001 215/11.3 |
| 5,195,658 A * | 3/1993 | Hoshino | B65D 75/48 206/219 |

(Continued)

FOREIGN PATENT DOCUMENTS

| | | |
|---|---|---|
| CN | 2790256 Y | 6/2006 |
| CN | 2800889 Y | 8/2006 |

(Continued)

OTHER PUBLICATIONS

International Search Report dated Nov. 25, 2016 received in corresponding application No. PCT/CN2016/098181 (5 pages).

(Continued)

*Primary Examiner* — Andrew T Kirsch

(74) *Attorney, Agent, or Firm* — Finnegan, Henderson, Farabow, Garrett & Dunner, L.L.P.

(57) ABSTRACT

A soft core bottle includes a bottle housing and a liner. The liner includes a first bottle opening and a first bottle body. The first bottle body is made of a soft material. The bottle housing is made of a hard material. The liner is attached to the bottle housing via the first bottle opening in an assembled state.

15 Claims, 6 Drawing Sheets

(56) References Cited

U.S. PATENT DOCUMENTS

| | | | | |
|---|---|---|---|---|
| 5,356,016 | A * | 10/1994 | Wiedemann | A61J 9/001 215/11.1 |
| 5,882,119 | A | 3/1999 | Fadal, II | |
| 2002/0153381 | A1 | 10/2002 | Rohe | |
| 2005/0056610 | A1 | 3/2005 | Randolph et al. | |
| 2005/0184075 | A1 | 8/2005 | Belcastro | |
| 2013/0075393 | A1 | 3/2013 | Haynie | |

FOREIGN PATENT DOCUMENTS

| | | | |
|---|---|---|---|
| CN | 201542254 | U | 8/2010 |
| CN | 202154451 | U | 3/2012 |
| CN | 203609143 | U | 5/2014 |
| CN | 203914344 | U | 11/2014 |
| CN | 203914352 | U | 11/2014 |
| CN | 204232782 | U | 4/2015 |
| CN | 105105501 | A | 12/2015 |
| CN | 105708272 | A | 6/2016 |
| JP | S51157379 | U | 12/1976 |
| JP | 2013-47104 | A | 3/2013 |
| JP | 5713235 | B2 | 5/2015 |

OTHER PUBLICATIONS

Extended European Search Report in corresponding European Application No. 17160564.5 dated Sep. 7, 2017.

English translation of International Search Report dated Nov. 25, 2016 received in corresponding application No. PCT/CN2016/098181.

* cited by examiner

SOFT CORE BOTTLE

CROSS-REFERENCE TO RELATED APPLICATIONS

The present application is based on and claims priority to Chinese patent Application No. 201610150867.4, filed on Mar. 16, 2016, which is hereby incorporated by reference in its entirety.

TECHNICAL FIELD

The disclosure relates to a technical field of bottles and, more particularly, to a soft core bottle.

BACKGROUND

A bottle is a container that can be used to contain liquid. When a bottle is used for a long time, dirt deposits may accumulate on an inner wall of the bottle.

A commercially available bottle is typically made of a hard material. When a user needs to clean the inner wall of the bottle so as to remove the dirt deposits from the bottle, the user may have to stretch his/her hand into the bottle and clean the bottle using a cleaning tool.

SUMMARY

In order to eliminate inconvenience in cleaning a bottle made of a hard material, the present disclosure provides a soft core bottle. Technical solutions of the present disclosure are provided as follow:

According to some embodiments of the present disclosure, a soft core bottle is provided. The soft core bottle includes a bottle housing and a liner. The liner includes a first bottle opening and a first bottle body. The first bottle body is made of a soft material. The bottle housing is made of a hard material, and the liner is attached to the bottle housing via the first bottle opening in an assembled state.

It should be appreciated that both the foregoing general description and the following detailed description are exemplary only and are not restrictive of the present disclosure.

BRIEF DESCRIPTION OF THE DRAWINGS

The accompanying drawings, which are incorporated in and constitute a part of this specification, illustrate several aspects of the present disclosure described below, and together with the description, serve to explain the principles of the present disclosure.

DETAILED DESCRIPTION

Figure 1:
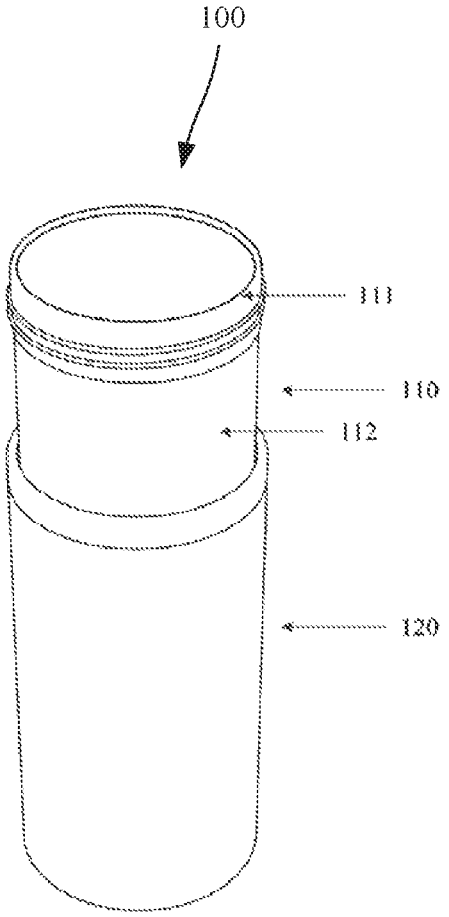
FIG. 1 illustrates a schematic structural view of portions of a soft core bottle in an unassembled state according to an exemplary embodiment.

Exemplary embodiments will be explained in detail, examples of which are illustrated in the drawings. In the following descriptions of the drawings, unless otherwise stated, the same numbers indicate the same or similar elements throughout the drawings. Implementations described in the following exemplary embodiments do not represent all implementations consistent with the present disclosure. Instead, they are merely examples of apparatuses and methods consistent with certain aspects of the present disclosure as recited in the appended claims.

FIG. 1 illustrates a schematic structural view of portions of a soft core bottle 100 in an unassembled state according to an exemplary embodiment. As shown in FIG. 1, the soft core bottle 100 includes a bottle housing 120 and a liner 110. FIG. 1 shows the liner 110 partially disposed within the bottle housing 120 in the unassembled state.

The liner 110 includes a first bottle opening 111 and a first bottle body 112. The first bottle body 112 is made of a soft material.

The bottle housing 120 is made of a hard material. FIG. 1 shows the soft core bottle 100 in an unassembled state, in which the liner 110 is partially inserted into the bottle housing 120. In an assembled state (e.g., the state shown in FIG. 5), the liner 110 is inserted further into the bottle housing 120 from the state shown in FIG. 1, such that the liner 110 is securely attached to the bottle housing 120 via the first bottle opening 111 by engaging threads provided on the first bottle opening 111 with threads provided on the bottle housing 120, as described below in connection with FIG. 4.

The first bottle body 112 of the liner 110 included in the soft core bottle 100 is made of a soft material. Because the soft material of the first bottle body 112 can easily deform when subject to a force or pressure, a user can clean an inner wall of the liner 110 by squeezing and kneading the liner 110. With the disclosed soft core bottle 100, inconvenience associated with cleaning a conventional, commercially available bottle made of a hard material is resolved. As a result, a user can conveniently and quickly clean the soft core bottle 100 using his/her hands without using any tools.

The soft core bottle 100 having the liner 110 made of a soft material assembled in a matching bottle housing 120 can contain liquid and be easily cleaned. Additional details of the structure of the soft core bottle 100 are described below in connection with FIGS. 2 and 4.

Figure 2:
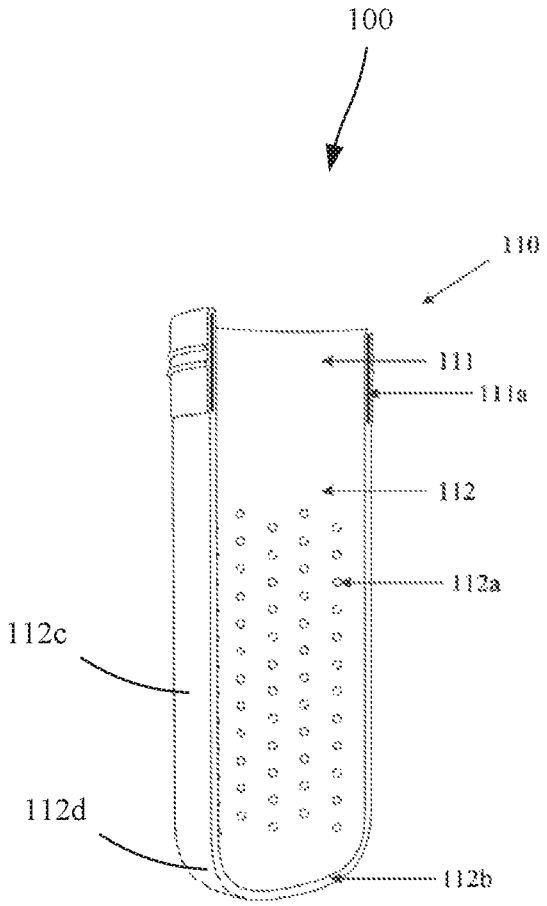
FIG. 2 illustrates a schematic cutaway structural view of a section of a liner of a soft core bottle according to an exemplary embodiment.

FIG. 2 illustrates a schematic cutaway structural view of a section of the liner 110 of the soft core bottle 100 according to an exemplary embodiment.

The liner 110 includes the first bottle opening 111 and the first bottle body 112. The first bottle body 112 is made of a soft material. The soft material deforms easily when it is subject to a pressure or force, and can recover its shape when the pressure or force is removed.

The material of the first bottle opening 111 of the liner 110 can be a hard material or a soft material. In embodiments where the material of the first bottle opening 111 is a hard material, the first bottle opening 111 can be joined with the first bottle body 112 using a soft material. In embodiments where the material of the first bottle opening 111 is a soft material, the first bottle opening 111 and the first bottle body 112 can be integrally formed as a single portion of the liner 110.

In some embodiments, the first bottle opening 111 is firstly formed by a first injection molding using a hard material, and the first bottle body 112 is subsequently formed by a second injection molding performed on the first bottle opening 111 using a soft material, such that a portion of the soft material encloses a surface of the first bottle opening 111 injection molded using the hard material. Referring to FIG. 2, to form the first bottle opening 111, an inner layer 111*a* of the first bottle opening 111, which is shown as a black core portion of the first bottle opening 111 in FIG. 2, is firstly formed by the first injection molding using the hard material. Subsequently, the inner layer 111*a* (e.g., a black core portion shown in FIG. 2) of the first bottle opening 111 is processed by a second injection molding using a soft material, such that the soft material encloses a surface of the inner layer 111*a*. As a result of the two injection molding processes, the first bottle opening 111 is formed.

As shown in FIG. 2, the first bottle body 112 includes a body portion 112*c* and a bottom portion 112*b*, which are joined with each other via an arcuate joining portion 112*d*, such that the bottom portion 112*b* of the first bottle body 112 forms a bottle bottom, which can be cleaned in a range of 360°, i.e., any location on the bottom portion 112*b* of the first bottle body 112 can be cleaned.

Figure 3:
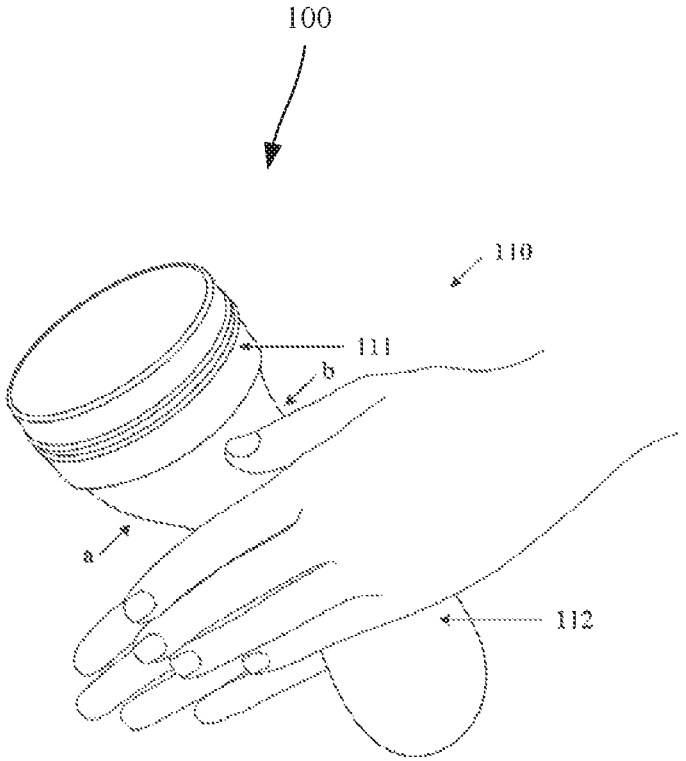
FIG. 3 illustrates a schematic structural view of a liner of a soft core bottle under a force or pressure according to an exemplary embodiment.

FIG. 3 illustrates a schematic structural view of the liner 110 of the soft core bottle 100 under a force or pressure according to an exemplary embodiment. As shown in FIG. 3, the liner 110 can be separated (e.g., removed, detached, or unscrewed) from the bottle housing 120 shown in FIG. 1 for cleaning. When an outer side wall of the first bottle body 112 of the liner 110 is subject to a pressure or force applied from outside toward inside (for example, in pressure directions a and b shown in FIG. 3), the first bottle body 112 deforms under the pressure or force. When the deformation of the first bottle body 112 reaches to a certain extent, different parts of an inner side wall of the first bottle body 112 contact each other and rub each other. Clean water may be injected into the liner 110 before or after the force or pressure is applied. The liner 110 is cleaned by kneading (e.g., squeezing) the first bottle body 112 with the clean water inside.

Referring back to FIG. 2, in some embodiments, a plurality of protruding points 112*a* are provided on the inner side wall of the first bottle body 112 of the liner 110. When the first bottle body 112 is kneaded or squeezed, friction generated on the inner side wall of the first bottle body 112 is increased due to the protruding points 112*a*. The increased friction results in an improved cleaning effect when the liner 110 is kneaded or squeezed manually.

In some embodiments, the first bottle body 112 of the liner 110 included in the soft core bottle 100 is made of a soft material. Because the soft material can easily deform under a force or pressure, a user can clean an inner wall of the liner 110 by squeezing and kneading the liner 110. With the disclosed soft core bottle 100, inconvenience associated with cleaning a conventional, commercially available bottle made of a hard material is resolved. As a result, a user can conveniently and quickly clean the bottle using his/her hands without using any tools.

In the disclosed embodiments, the inner side wall of the first bottle body 112 includes the plurality of protruding points 112*a*. As a result, the friction generated by rubbing different parts (including the protruding points 112*a*) of the inner side wall of the first bottle body 112 is increased. The increased friction improves the cleaning effect when the liner 110 is kneaded or squeezed manually.

In the disclosed embodiments, the body portion 112*c* and the bottom portion 112*b* of the first bottle body 112 are joined with each other by the arcuate joining portion 112*d*, such that the bottom portion 112*b* of the first bottle body 112 forms a bottle bottom that can be cleaned in a range of 360°, i.e., any location on the bottom portion 112*b* of the first bottle body 112 can be cleaned. With the disclosed soft core bottle 100, difficulty associated with cleaning the liner 100 by hand is reduced, and the cleaning effect is improved.

Figure 4:
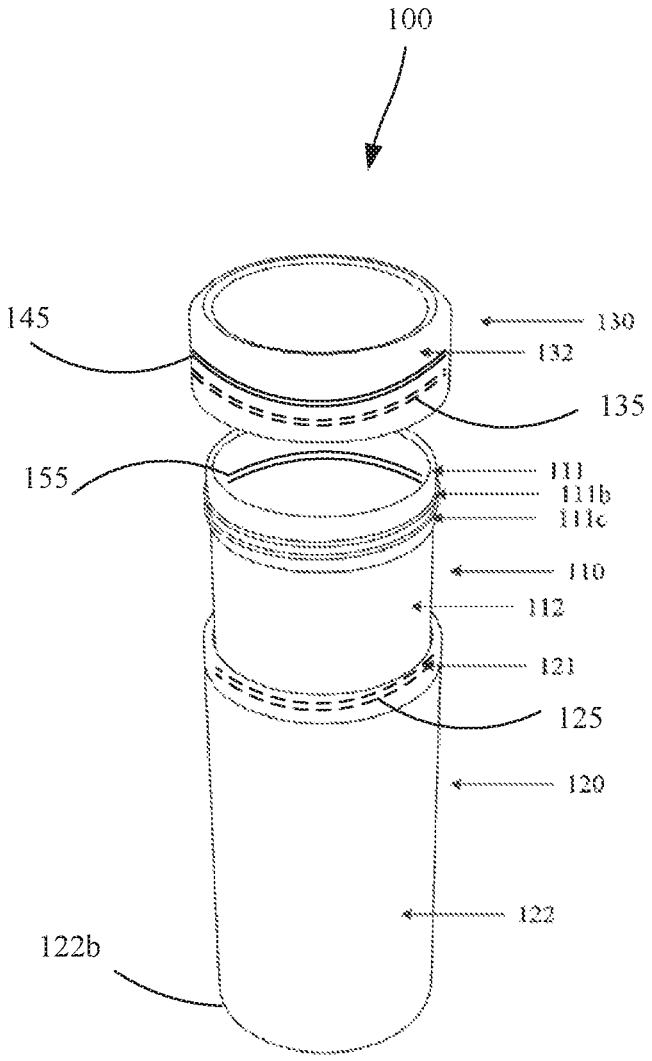
FIG. 4 illustrates a schematic structural view of a soft core bottle in a partially assembled state according to an exemplary embodiment.

FIG. 4 illustrates a schematic structural view of the soft core bottle 100 in a partially assembled state according to an exemplary embodiment. As shown in FIG. 4, the soft core bottle 100 includes the bottle housing 120.

In some embodiments, the bottle housing 120 is made of a hard material. In an assembled state (e.g., the state shown in FIG. 5), the liner 110 is positioned at least partially inside the bottle housing 120, and securely attached to the bottle housing 120 via threads provided on the first bottle opening 111. The bottle housing 120 includes a second bottle opening 121 and a second bottle body 122. An inner side wall of the second bottle opening 121 is screwed onto an outer side wall of the first bottle opening 111 by engaging threads provided on the inner side wall of the second bottle opening 121 with threads provided on the outer side wall of the first bottle opening 111. The first bottle opening 111 has an outer diameter that is equal to an inner diameter of the second bottle opening 121.

In some embodiments, the second bottle opening 121 is attached to the first bottle opening 111 in any one of the following two manners:

In a first manner, the threads on the inner side wall of the second bottle opening 121 and the threads on the outer side wall of the first bottle opening 111 are rotation type threads. The inner side wall of the second bottle opening 121 is screwed onto the outer side wall of the first bottle opening 111 by engaging these threads with each other in a rotation manner. In some embodiments, the threads on both the inner side wall of the second bottle opening 121 and the outer side wall of the first bottle opening 111 are male threads. Alternatively, in some embodiments, the threads on the inner side wall of the second bottle opening 121 are male threads while the threads on the outer side wall of the first bottle opening 111 are female threads. In some embodiments, the threads on the inner side wall of the second bottle opening 121 are female threads while the threads on the outer side wall of the first bottle opening 111 are male threads.

In a second manner, the threads on the inner side wall of the second bottle opening 121 and the threads on the outer side wall of the first bottle opening 111 are non-rotation type threads. These threads may be made of a soft material. The threads on both the inner side wall of the second bottle opening 121 and the outer side wall of the first bottle opening 111 are parallel with the first bottle opening 111. In an assembled state (e.g., the state shown in FIG. 5), the inner side wall of the second bottle opening 121 is attached to the outer side wall of the first bottle opening 111 by engaging the threads in a sealing matter by which the liner 110 is sealingly attached to the bottle housing 120. In some embodiments, the threads on both the inner side wall of the second bottle opening 121 and the threads on the outer side wall of the first bottle opening 111 are male threads. In some embodiments, the threads on the inner side wall of the second bottle opening 121 are male threads while the threads on the outer side wall of the first bottle opening 111 are female threads. In order to fasten the liner 110 to the bottle housing 120 when the threads on both the inner side wall of the second bottle opening 121 and the outer side wall of the first bottle opening 111 are male threads, the numbers of the threads on the second bottle opening 121 and/or the first bottle opening 111 are at least two.

Other manners may be used to attach the second bottle opening 121 to the first bottle opening 111, which are within the scope of the present disclosure.

In some embodiments, when assembled, the liner 110 is provided inside the bottle housing 120. The inner diameter of the first bottle opening 111 is equal to the inner diameter of the first bottle body 112. The outer diameter of the first bottle opening 111 is larger than the outer diameter of the first bottle body 112. The outer diameter of the first bottle body 112 is smaller than the inner diameter of the second bottle body 122, such that a gap is formed between the first bottle body 112 and the second bottle body 122, in order to make the soft core bottle 100 thermally insulating and heat retaining.

In some embodiments, in order to prevent the liner 110 from swaying inside the bottle housing 120 after being filled with liquid, in the assembled state, the bottom portion 112*b* (shown in FIG. 2) of the first bottle body 112 contacts a bottom portion 122*b* (shown in FIG. 4) of the second bottle body 122 when the liner 110 is positioned inside the bottle housing 120.

In the disclosed embodiments, the first bottle body 112 of the liner 110 included in the soft core bottle 100 is made of a soft material. Since the soft material can deform easily when under a force or pressure, a user can clean an inner wall of the liner 110 by squeezing and kneading the liner 110. With the disclosed soft core bottle 100, inconvenience associated with cleaning a conventional, commercially available bottle made of a hard material is resolved. With the disclosed soft core bottle 100, a user can conveniently and quickly clean the bottle 100 using his/her hands without using any tools.

In the disclosed embodiments, the inner side wall of the second bottle opening 121 is screwed onto the outer side wall of the first bottle opening 111 by engaging threads provided on the inner side wall of the second bottle opening 121 with the threads provided on the outer side wall of the first bottle opening 111, such that the liner 110 is securely attached to the bottle housing 120, thereby preventing the liner 110 from swaying inside the bottle housing 120 or dropping out of the bottle housing 120.

In the disclosed embodiments, by making the bottom portion 112*b* (shown in FIG. 2) of the first bottle body 112 to rest on and contact the bottom portion 122*b* of the second bottle body, the liner 110 is prevented from swaying inside the bottle housing 120 after it is filled with liquid and the liquid is prevented from leaking out of the soft core bottle 100.

In the disclosed embodiments, since the outer diameter of the first bottle body 112 is smaller than the inner diameter of the second bottle body 122, a gap is formed between the first bottle body 112 and the second bottle body 122, and the soft core bottle 100 is made thermally insulating and heat retaining.

In some embodiments, in order to keep the temperature of the liquid (e.g., water) stored inside the liner 110 of the soft core bottle 100, or to improve the convenience of carrying the soft core bottle 100 (with the liner 110 of which is filled with water), the soft core bottle 100 further includes the bottle cover 130 shown in FIG. 4.

To assemble the separate components of the soft core bottle 100 shown in FIG. 4, in some embodiments, the inner side wall of the second bottle opening 121 is screwed onto a lower portion of the outer side wall of the first bottle opening 111 through threads 111*c* provided on the outer side wall of the first bottle opening 111. For example, the inner side wall of the second bottle opening 121 may be provided with threads 125 that can be screwed onto the threads 111*c* provided on the outer side wall of the first bottle opening 111. In some embodiments, an inner side wall of a cover body 132 is screwed onto an upper portion of the outer side wall of the first bottle opening 111 through threads 111*b* provided on the outer side wall of the first bottle opening 111. For example, the inner side wall of the cover body 132 may be provided with threads 135 that can be screwed onto the threads 111*b* provided on the outer side wall of the first bottle opening 111.

When the bottle cover 130 is made of a hard material, if the threads (e.g., threads 111*b* provided on the first bottle opening 111) are made of a material with properties different from those of the hard material, the cover body 132 and the first bottle opening 111 may be attached with each other in one of the following manners:

(1) When the bottle cover 130 is made of a hard material and the inner diameter of the cover body 132 is equal to the outer diameter of the first bottle opening 111, the cover body 132 can be attached to the first bottle opening 111 in any one of the following two manners:

In a first manner, when the threads 135 provided on the inner side wall of the cover body 132 and the threads 111*b* provided on the outer side wall of the first bottle opening 111 are rotation type threads, the threads 135 provided on the inner side wall of the cover body 132 are screwed onto the threads 111*b* provided on the outer side wall of the first bottle opening 111 in a rotation manner. In some embodiments, the threads 135 and 111*b* on both the inner side wall of the cover body 132 and the outer side wall of the first bottle opening 111 may be male threads. Alternatively, in some embodiments, the threads 135 on the inner side wall of the cover body 132 are male threads while the threads 111*b* on the outer side wall of the first bottle opening 111 are female threads. In some embodiments, the threads 135 on the inner side wall of the cover body 132 are female threads while the threads 111*b* on the outer side wall of the first bottle opening 111 are male threads.

In a second manner, the threads 135 on the inner side wall of the cover body 132 and the threads 111*b* on the outer side wall of the first bottle opening 111 are non-rotation type threads, and both of the threads are made of a soft material. The threads 135 and 111*b* on both the inner side wall of the cover body 132 and the outer side wall of the first bottle opening 111 are parallel with the first bottle opening 111. In an assembled state, the threads 135 on the inner side wall of the cover body 132 are engaged with the threads 111*b* on the outer side wall of the first bottle opening 111 in a sealing manner such that the threads 135 and 111*b* are sealingly engaged with each other. In some embodiments, the threads 135 and 111*b* on both the inner side wall of the cover body 132 and the outer side wall of the first bottle opening 111 may be male threads. Alternatively, in some embodiments, the threads 135 on the inner side wall of the cover body 132 are male threads while the threads 111*b* on the outer side wall of the first bottle opening 111 are female threads. In order to fasten the bottle cover 130 to the first bottle opening 111, when the threads 135 and 111*b* on both the inner side wall of the cover body 132 and the outer side wall of the first bottle opening 111 are male threads, the numbers of the threads 135 and 111*b* on the cover body 132 and/or the first bottle opening 111 are at least two.

Other manners for attaching the cover body 132 to the first bottle opening 111 may also be used, which are within the scope of the present disclosure.

(2) When the bottle cover 130 is made of a hard material and the outer diameter of the cover body 132 is equal to the inner diameter of the first bottle opening 111, the cover body 132 may be attached to the first bottle opening 111 in any one of the following two manners:

In a first manner, in some embodiments, threads 145 are provided on the outer side wall of the cover body 132 and threads 155 are provided on the inner side wall of the first bottle opening 111. Threads 145 and 155 are rotation type threads. In some embodiments, to assemble the soft core bottle 100, the outer side wall of the cover body 132 is screwed onto the inner side wall of the first bottle opening 111 by engaging the threads 145 on the outer side wall of the cover body 132 with the threads 155 on the inner side wall of the first bottle opening 111 in a rotation manner. In some embodiments, the threads 145 on the outer side wall of the cover body 132 and the threads 155 on the inner side wall of the first bottle opening 111 may be male threads. Alternatively, in some embodiments, the threads 145 on the outer side wall of the cover body 132 are male threads while the threads 155 on the inner side wall of the first bottle opening 111 are female threads. In some embodiments, the threads 145 on the outer side wall of the cover body 132 are female threads while the threads 155 on the inner side wall of the first bottle opening 111 are male threads.

In a second manner, the threads 145 on the outer side wall of the cover body 132 and the threads 155 on the inner side wall of the first bottle opening 111 are non-rotation type threads, and the threads 145 and 155 are made of a soft material. The threads 145 on the outer side wall of the cover body 132 and the threads 155 on the inner side wall of the first bottle opening 111 are parallel with the first bottle opening 111. To assemble the soft core bottle 100, in some embodiments, the outer side wall of the cover body 132 is attached to the inner side wall of the first bottle opening 111 by engaging the threads 145 and 155 in a sealing manner, such that the threads 145 and 155 are sealingly engaged with each other. In some embodiments, the threads 145 on the outer side wall of the cover body 132 and the threads 155 on the inner side wall of the first bottle opening 111 are both male threads. Alternatively, in some embodiments, the threads 145 on the outer side wall of the cover body 132 are male threads while the threads 155 on the inner side wall of the first bottle opening 111 are female threads. In order to fasten the bottle cover 130 to the bottle housing 120, when the threads 145 on the outer side wall of the cover body 132 and the threads 155 on the inner side wall of the first bottle opening 111 are male threads, the numbers of the threads 145 and/or 155 on the cover body 132 and/or the first bottle opening 111 are at least two.

Other manners for attaching the cover body 132 to the first bottle opening 111 may be used, which are also within the scope of the present disclosure.

Figure 5:
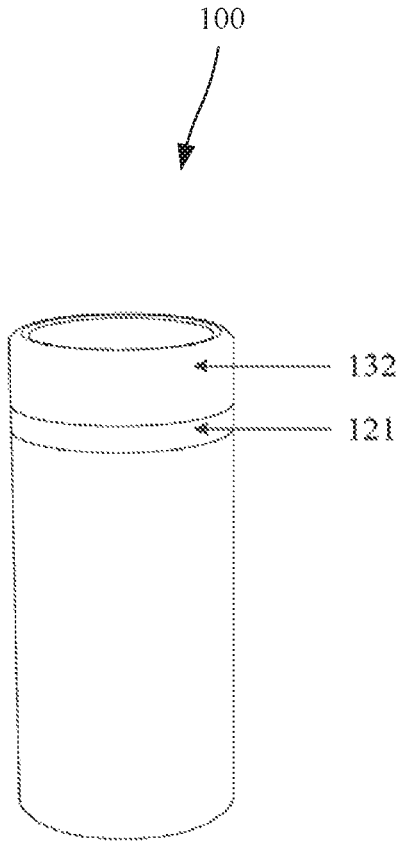
FIG. 5 illustrates a schematic structural view of a soft core bottle in an assembled state according to an exemplary embodiment.

FIG. 5 illustrates a schematic structural view of the soft core bottle 100 in an assembled state according to an exemplary embodiment. As shown in FIG. 5, in the assembled state, the cover body 132 is joined to an upper edge of the second bottle opening 121 after being screwed onto the first bottle opening 111.

Referring back to FIG. 4, in some embodiments, when the bottle cover 130 is made of a soft material, the inner diameter of the cover body 132 is equal to the outer diameter of the first bottle opening 111. The bottle cover 130 is attached to the first bottle opening 111 in such a manner that the inner side wall of the cover body 132 encloses an upper portion of the outer side wall of the first bottle opening 111 to form a seal. The inner side wall of the cover body 132 and the upper portion of the outer side wall of the first bottle opening 111 may or may not have threads.

Alternatively, in some embodiments, the bottle cover 130 is made of a soft material. The inner diameter of the cover body 132 is equal to the outer diameter of the second bottle opening 121, and in an assembled state, the bottle cover 130 is attached to the second bottle opening 121 in such a manner that the inner side wall of the cover body 132 encloses an upper portion of the outer side wall of the second bottle opening 121 to form a seal. The inner side wall of the cover body 132 and the upper portion of the outer side wall of the second bottle opening 121 may or may not have threads.

Figure 6:
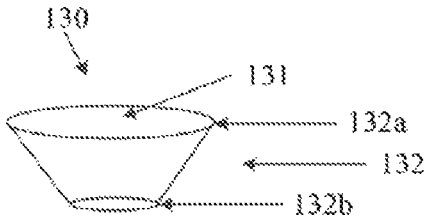
FIG. 6 illustrates a schematic structural view of a bottle cover for a soft core bottle according to an exemplary embodiment.

In some embodiments, the structure of the bottle cover 130 may also be any other type of structure that can be used with the first opening 111, such as the structure shown in FIG. 6.

FIG. 6 illustrates a schematic structural view of another structure of the bottle cover 130 for the soft core bottle 100 according to another exemplary embodiment. As shown in FIG. 6, the bottle cover 130 includes a cover top 131 and the cover body 132. An outer diameter of a first end 132*a* of the cover body 132 is larger than an outer diameter of a second end 132*b* of the cover body 132. For example, the bottle cover 130 has a frusto-conical shape, which has circular cross sections with cross-sectional areas decreasing from top (e.g., the first end 132*a*) to bottom (e.g., the second end 132*b*). The first end 132*a* of the cover body 132 connects with the cover top 131. The outer diameter of the first end 132*a* of the cover body 132 is larger than the inner diameter of the first bottle opening 111. The second end 132*b* of the cover body 132 is received inside the first bottle opening 111.

The hard material used in various embodiments may be stainless steel, plastic, etc. The soft material may be silica gel, rubber, etc. The present disclosure does not limit the type of the hard material or the soft material.

In the disclosed embodiments, the first bottle body 112 of the liner 100 included in the soft core bottle 100 is made of a soft material. Because the soft material can deform easily under a force or pressure, a user can clean an inner wall of the liner 110 by squeezing or kneading the liner 110. With the disclosed soft core bottle 100, inconvenience associated with cleaning a conventional, commercially available bottle made of a hard material is resolved. A user may conveniently and quickly clean the bottle using only his/her hands without using any tool.

In some embodiments, the inner side wall of the bottle cover 130 is screwed onto the upper portion of the outer side wall of the first bottle opening 111 by engaging threads provided on the inner side wall of the bottle cover 130 with threads provided on the upper portion of the outer side wall of the first bottle opening 111, such that the bottle cover 130 is fastened to the first bottle opening 111 of the liner 110, thereby sealing the liner 110 and preventing leakage of liquid from the liner 110.

In some embodiments, the bottle cover 130 is configured to have a frusto-conical shape whose cross sectional areas decrease from top to bottom, or parallel threads are provided on the outer side wall of the cover body 132 of the bottle cover 130, the first bottle opening 111 can be tightly covered by the bottle cover 130, thereby sealing the liner 110 and preventing leakage of liquid from the liner 110.

In some embodiments, due to the deformability and sealability of a soft material, the inner side wall of the cover body 132 made of the soft material encloses the outer side wall of the first bottle opening 111 or the outer side wall of the second bottle opening 121 to form a seal, such that the first bottle opening 111 can be tightly covered by the bottle cover 130, thereby sealing the liner 110 and preventing leakage of liquid from the liner 110.

Other embodiments of the present disclosure will be apparent to those skilled in the art from consideration of the descriptions and implementations disclosed herein. The application is intended to cover any modification, use or adaptive variation of the present disclosure that follow the general principles of the present disclosure, including such departures from the present disclosure as come within the common knowledge and customary practice in the art. The description and the embodiments are deemed as exemplary only, with the true scope and spirit of the invention being indicated by the following claims.

It will be appreciated that the present disclosure is not limited to the exact structure described above and shown in the drawings, and various variations and modifications can be made without departing from the scope of the present disclosure. The scope of the present disclosure is only limited by the appended claims.

What is claimed is:

1. A soft core bottle, comprising:

a bottle housing; and a liner;

wherein the liner includes a first bottle opening and a first bottle body, the first bottle body being made of a soft material, wherein the bottle housing is made of a hard material, wherein the liner is attached to the bottle housing via the first bottle opening in an assembled state, wherein an inner side wall of the first bottle body includes a plurality of protruding points, and wherein the bottle housing comprises a second bottle opening and a second bottle body, and a bottom portion of the first bottle body maintains contact with a horizontal, flat, and supporting bottom portion of the second bottle body when the liner is positioned in the second bottle body, wherein the soft core bottle further includes a bottle cover including a cover body, an inner side wall of the first bottle opening is provided with a plurality of first threads, an outer side wall of the cover body is provided with a plurality of second threads, both of the first threads and the second threads are parallel with the first bottle opening, and the outer side wall of the cover body is attached to an upper portion of the inner side wall of the first bottle opening by engaging the first threads and the second threads in a sealing manner.

2. The soft core bottle according to claim 1, wherein an inner side wall of the second bottle opening is screwed onto an outer side wall of the first bottle opening through a plurality of third threads provided on the outer side wall of the first bottle opening.

3. The soft core bottle according to claim 2 wherein the bottle cover is made of a soft material.

4. The soft core bottle according to claim 3, wherein the first bottle opening is firstly formed by injection molding using a hard material, and the first bottle body is subsequently formed by injection molding the first bottle opening using a soft material such that a portion of the soft material encloses a surface of the first bottle opening.

5. The soft core bottle according to claim 2, wherein an inner diameter of the first bottle opening is equal to an inner diameter of the first bottle body, an outer diameter of the first bottle opening is larger than an outer diameter of the first bottle body, and the outer diameter of the first bottle body is smaller than an inner diameter of the second bottle body.

6. The soft core bottle according to claim 5, wherein the first bottle opening is firstly formed by injection molding using a hard material, and the first bottle body is subsequently formed by injection molding the first bottle opening using a soft material such that a portion of the soft material encloses a surface of the first bottle opening.

7. The soft core bottle according to claim 2, wherein the first bottle opening is firstly formed by injection molding using a hard material, and the first bottle body is subsequently formed by injection molding the first bottle opening using a soft material such that a portion of the soft material encloses a surface of the first bottle opening.

8. The soft core bottle according to claim 1 wherein the bottle cover is made of a hard material.

9. The soft core bottle according to claim 8, wherein the first bottle opening is firstly formed by injection molding using a hard material, and the first bottle body is subsequently formed by injection molding the first bottle opening using a soft material such that a portion of the soft material encloses a surface of the first bottle opening.

10. The soft core bottle according to claim 1, wherein the first bottle opening is joined with the first bottle body through a soft material.

11. The soft core bottle according to claim 10, wherein the first bottle opening is firstly formed by injection molding using a hard material, and the first bottle body is subsequently formed by injection molding the first bottle opening using a soft material such that a portion of the soft material encloses a surface of the first bottle opening.

12. The soft core bottle according to claim 1, wherein a bottle body portion and a bottom portion of the first bottle body are joined with each other via an arcuate joining portion.

13. The soft core bottle according to claim 12, wherein the first bottle opening is firstly formed by injection molding using a hard material, and the first bottle body is subsequently formed by injection molding the first bottle opening using a soft material such that a portion of the soft material encloses a surface of the first bottle opening.

14. The soft core bottle according to claim 1, wherein the first bottle opening is firstly formed by injection molding using a hard material, and the first bottle body is subsequently formed by injection molding the first bottle opening using a soft material such that a portion of the soft material encloses a surface of the first bottle opening.

15. The soft core bottle according to claim 1, wherein the first threads and the second threads are made of a soft material.

* * * * *